US009132888B1

(12) United States Patent
Steury

(10) Patent No.: US 9,132,888 B1
(45) Date of Patent: Sep. 15, 2015

(54) BOAT HULL

(71) Applicant: Douglas Steury, New Paris, IN (US)

(72) Inventor: Douglas Steury, New Paris, IN (US)

(73) Assignee: DL4, LLC, New Paris, IN (US)

( * ) Notice: Subject to any disclaimer, the term of this patent is extended or adjusted under 35 U.S.C. 154(b) by 0 days.

(21) Appl. No.: 14/226,900

(22) Filed: Mar. 27, 2014

(51) Int. Cl.
*B63B 1/00* (2006.01)
*B63B 3/00* (2006.01)

(52) U.S. Cl.
CPC ..... *B63B 3/00* (2013.01)

(58) Field of Classification Search
USPC ..... 114/62, 61.27, 61.28, 61.29, 61.3, 114/61.32, 61.33
IPC ..... B63B 1/20,3/00
See application file for complete search history.

(56) References Cited

U.S. PATENT DOCUMENTS

| | | | | | |
|---|---|---|---|---|---|
| 793,944 | A | * | 7/1905 | Manker | 114/62 |
| 1,795,596 | A | | 10/1931 | Fleming et al. | |
| 2,474,667 | A | * | 6/1949 | Harvey | 114/290 |
| 3,075,488 | A | | 1/1963 | Wolf | |
| 3,225,729 | A | | 12/1965 | Ewing, Jr. | |
| 3,288,100 | A | * | 11/1966 | Cox et al. | 440/44 |
| 3,363,598 | A | | 1/1968 | Mortrude | |
| 3,802,370 | A | | 4/1974 | Collier | |
| 3,807,337 | A | | 4/1974 | English et al. | |
| 3,930,455 | A | | 1/1976 | Bremer | |
| 4,022,143 | A | | 5/1977 | Krenzler | |
| 4,233,920 | A | | 11/1980 | Wood et al. | |
| 4,708,085 | A | | 11/1987 | Blee | |
| 4,753,184 | A | | 6/1988 | Schiavone | |
| 5,063,868 | A | | 11/1991 | Fink, Jr. | |
| 5,419,274 | A | | 5/1995 | van Diepen | |
| 5,456,202 | A | | 10/1995 | Schoell | |
| 5,588,389 | A | | 12/1996 | Carter, Jr. | |
| 5,685,253 | A | | 11/1997 | Alexander, Jr. | |
| 6,138,602 | A | | 10/2000 | Cary | |
| 6,708,642 | B1 | | 3/2004 | Taylor | |
| D582,499 | S | * | 12/2008 | Hoffman | D21/803 |

* cited by examiner

*Primary Examiner* — Stephen Avila
(74) *Attorney, Agent, or Firm* — Michael A. Myers; Myers & Associates

(57) ABSTRACT

An improved boat hull is described. The new hull includes a bow, a stern and a lower longitudinal keel extending between the bow and stern. The hull includes a first V hull formed at the bow and a second V hull formed aft the bow. The second V hull is defined by a bilaterally symmetrical indention having a forward end and a rearward end. The indention is directed rearwardly and outwardly from the lower longitudinal keel, and the rearward end of the indention is above the water line for displacement of water toward the stern on both the port-side and starboard side of the boat. The new hull provides a smooth, less jarring ride, a reduction of drag forces, and an improved load along with increased deck area.

11 Claims, 6 Drawing Sheets

BOAT HULL

BACKGROUND OF THE INVENTION

The invention relates generally to boats and, more particularly, to a boat hull design.

Traditional recreational boat hull designs are in the form of a V at the bow. They cut the water and divide the spray outward to the starboard and port sides of the boat. Transitioning from the bow to the boat's stern, however, the remainder of the hull resumes a more or less flat planar shape known as a "modified V." When hulls with this design impact large waves, the boat is lifted by the wave and then impacts the flatter mid portion of the vessel causing a jarring rough ride. Another problem with traditional hull designs is drag.

The midsection of the hull presents substantial surface area that contacts the water. Vertical acceleration when attempting to plane the craft is not optimum as a result. Drag reduces fuel efficiency and performance as well. Drag can be reduced in designs like the catamaran, which uses spaced twin hulls. But, it's a trade off. It is difficult to steer catamarans, and their turn radius is too wide. Other design innovations, like that disclosed in U.S. Pat. No. 3,807,337, take advantage of the characteristics of the twin keel at the bow. Deck support, however, is lacking in this three-point design.

Lack of support presents another problem to boating enthusiasts who desire more spacious decks on their boats. Most recreational boaters have trailerable-sized boats. Waters with large waves are not enjoyable for trailerable boats with large deck space, like a houseboat or pontoon. This places limitations on the utility of the size of boats that can be used in the Great Lakes, seas and coastal/intercoastal waters.

Thus, it would be advantageous to provide an improved boat hull for trailerable-sized boats. It would be advantageous if such a hull produced a smoother ride with less drag resulting in improved fuel economy and performance. Such a hull should be stable and supportive of a proportionately large deck area and have features that enable it to vertically accelerate on par with a traditional speedboat. The design should be capable of being readily incorporated into the hull construction without deviating from conventional forms of boat hull manufacture as well.

SUMMARY OF THE INVENTION

The invention relates generally to boats and, more particularly, to a boat hull design. The new design provides a smoother ride with less drag in any waterway that can produce large waves, including seas and coastal/intercoastal waters. The novel invention provides a double V hull design that effectively dampens the impact of large waves. A unique bilaterally symmetrical indention aft the bow serves as a second cut into the water to direct spray rearwardly and outwardly from the keel.

In one aspect of the invention, a boat hull is provided that includes a bow, a stern and a lower longitudinal keel extending between the bow and the stern. The hull includes a wishbone-shaped indention formed in the hull between the bow and the stern. A first support point is defined at a bow section on the lower longitudinal keel, and a second support point is defined aft the bow section on the lower longitudinal keel.

In another aspect of the invention a boat hull is provided that includes a bow, a stern and a lower longitudinal keel extending between the bow and stern. The hull includes a first V hull formed at the bow and a second V hull formed aft the bow. The second V hull is defined by a bilaterally symmetrical indention having a forward end and a rearward end. The indention is directed rearwardly and outwardly from the lower longitudinal keel, and the rearward end is above a water line for displacement of water toward the stern on both the portside and starboard side.

In still another aspect, the indention, in cross-sectional shape, defines a U cushioning surface.

In yet another aspect, the lower longitudinal keel, from bow to stern, includes a wave portion.

One object of the invention is to provide an improved boat hull design that provides a smoother ride with less drag resulting in improved fuel economy and performance. Related objects and advantages of the present invention will be apparent from the following description.

BRIEF DESCRIPTION OF THE DRAWINGS

The details of the invention, both as to its structure and operation, may be obtained by a review of the accompanying drawings, in which.

DETAILED DESCRIPTION OF INVENTION

Figure 1:
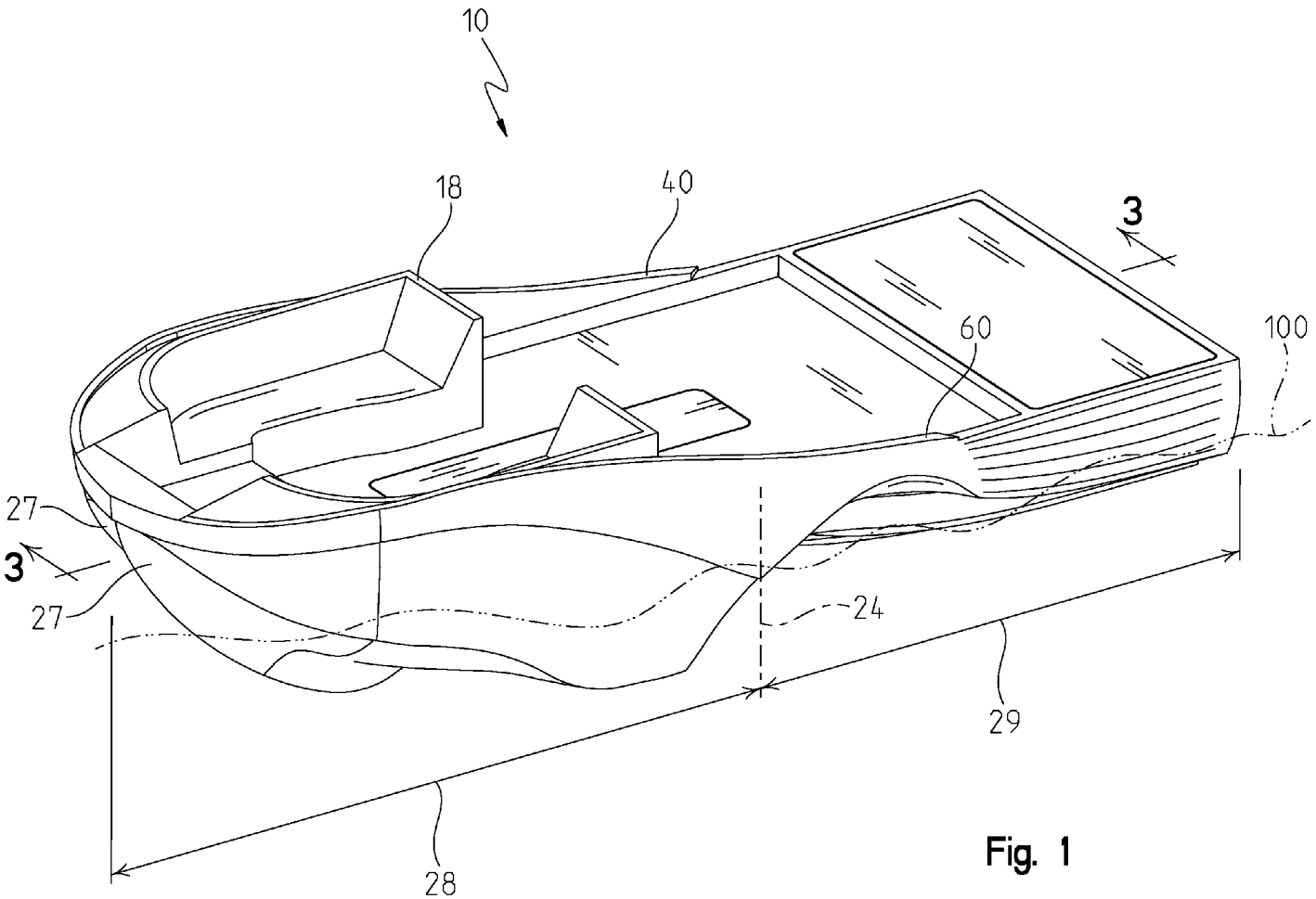
FIG. 1 is an isometric view of a boat incorporating the new boat hull of the invention.
Figure 2:
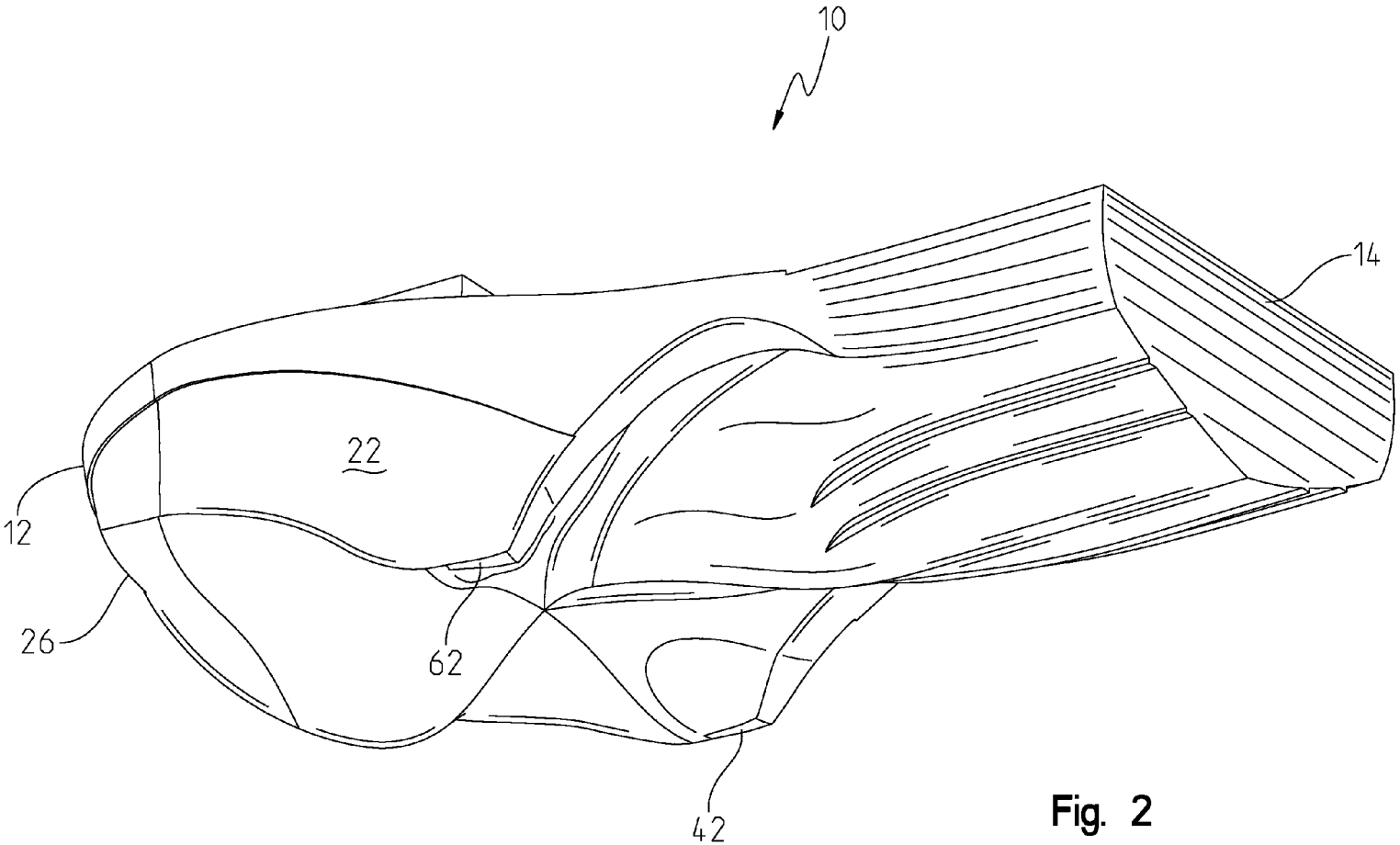
FIG. 2 is a bottom perspective view of an embodiment of the boat hull of the invention.

For the purposes of promoting an understanding of the principles of the invention, specific embodiments have been described. It should nevertheless be understood that the description is intended to be illustrative and not restrictive in character, and that no limitation of the scope of the invention is intended. Any alterations and further modifications in the described components, elements, processes, or devices, and any further applications of the principles of the invention as described herein, are contemplated as would normally occur to one skilled in the art to which the invention relates.

With reference to the figures, the new boat hull is shown formed integrally with an exemplary boat 10. The hull and deck of the boat may be integrally cast using reinforced fiberglass or other compositions popular in watercraft manufacturing. The deck may include fully proportioned pontoon furniture articles including chairs, helmsman seats, lounges 18, tables, and couches as desired. The operator's console (not shown) may be a single console positioned on the starboard side or a dual arrangement with one each on the starboard and port sides 40, 60 of the boat. One embodiment includes a console in the center of the deck in what is known us a "Bay" boat style. Most any arrangement of the deck furniture and console elements is contemplated by the invention and is structurally supported and especially stable due to the features of the novel hull described below.

Referring to FIGS. 1-4, the boat hull includes a bow 12, a stern 14 and a lower longitudinal keel 16 extending between the bow and stern. The bow of the hull is, preferably, V shaped. In the embodiment illustrated, more preferably, the bow 12 includes a first cut, or first V hull 26 characterized by a pair of bilaterally symmetrical impressions 27 that extend downward and outward from the bow 12. In one embodiment, the impressions 27, in cross-sectional shape, each defines a concave lift surface that extends downwardly and outwardly from the center of the bow 12. The first V hull 26 cuts the water and divides the spray outward to the starboard 40 and port 60 sides of the boat.

Figure 3:
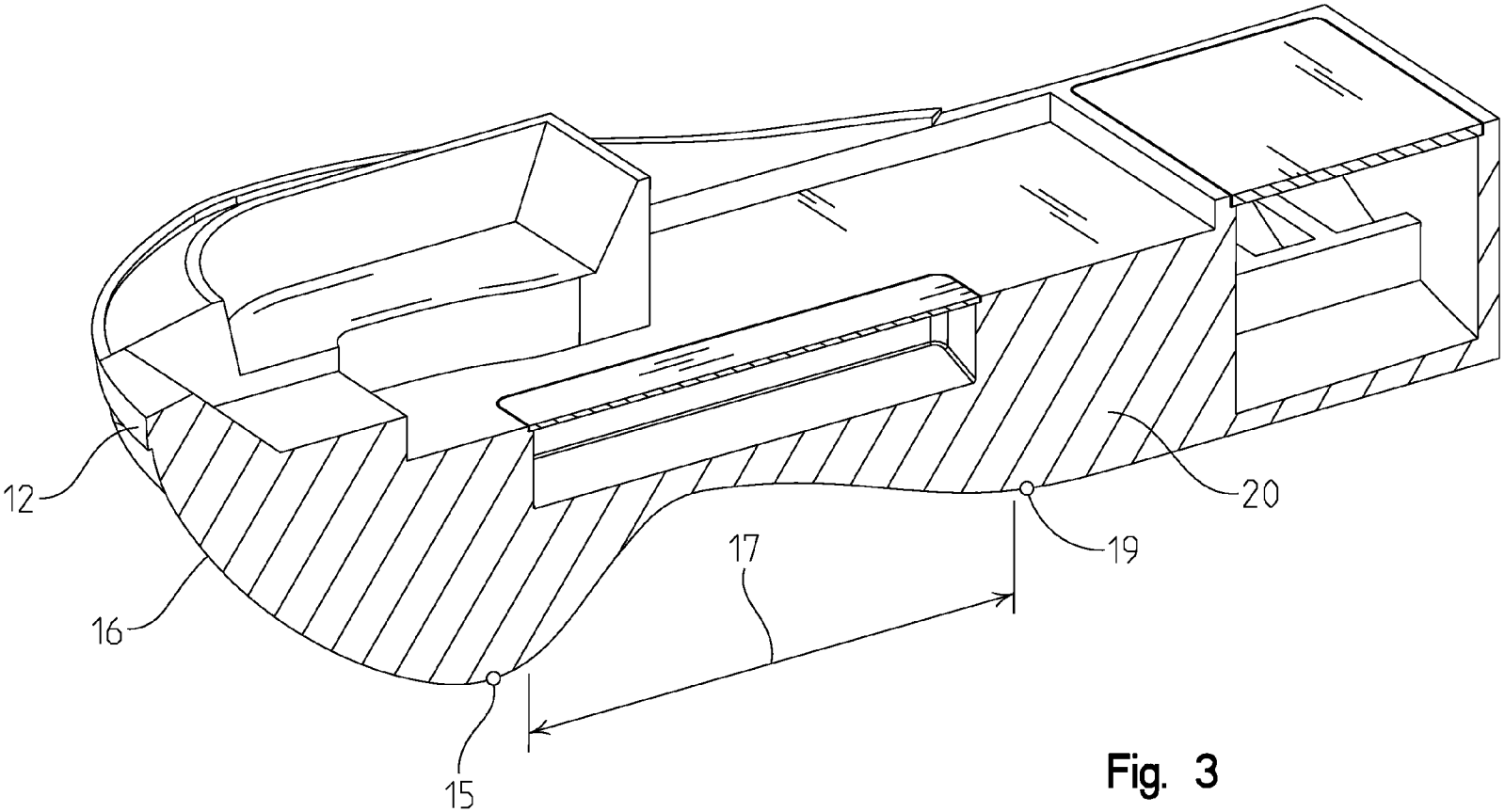
FIG. 3 is an elevated side view of an embodiment of the boat taken along lines 3-3 of FIG. 1.
Figure 4:
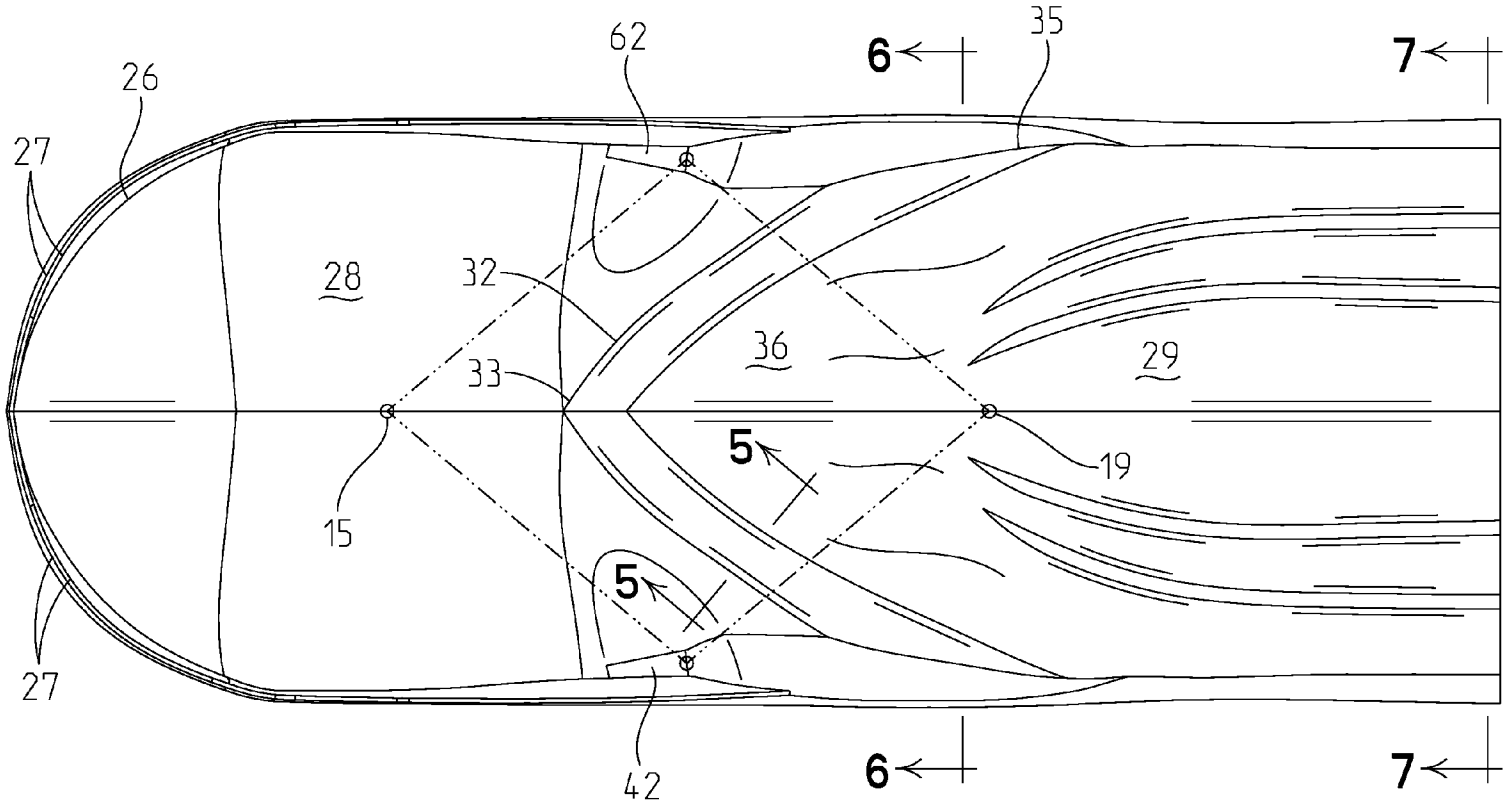
FIG. 4 is a bottom plan view of the boat hull of the invention.
Figure 5:
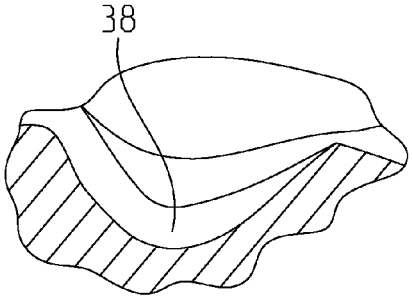
FIG. 5 is an enlarged fragmentary longitudinal vertical sectional view taken substantially upon the plane indicated by the section line 5-5 of FIG. 4.
Figure 6:
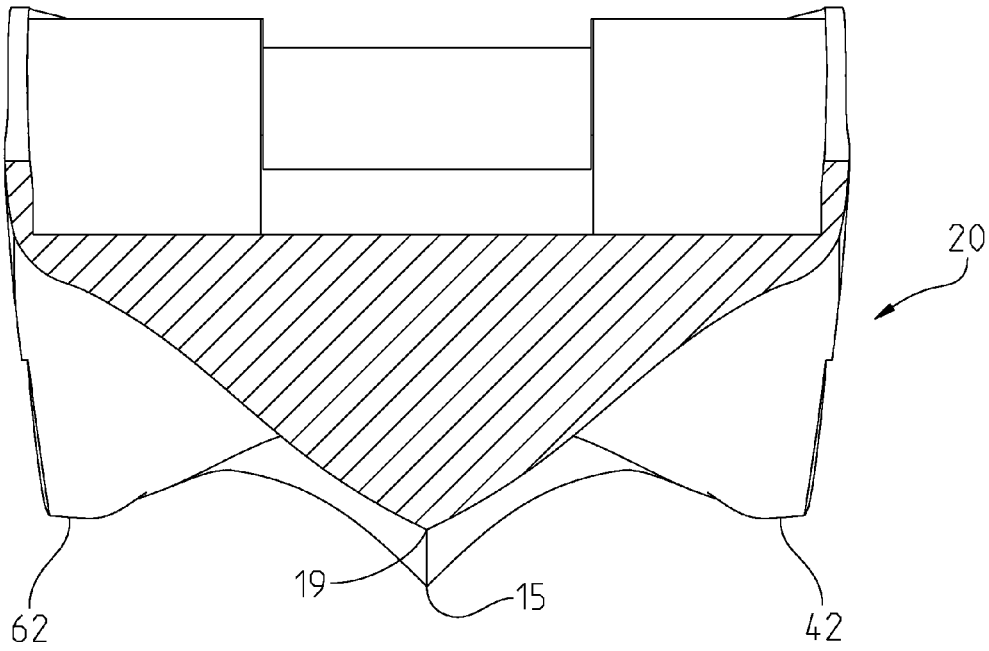
FIG. 6 is an enlarged sectional view taken along lines 6-6 of FIG. 4.

The bow portion 28 includes that portion of the hull 20 from the bow 12 to the midsection 24 of the hull. The stern portion 29 of the hull refers to the hull aft the boat's midsection to stern 14. The midsection of the boat and hull is viewable as a dotted line 24 shown in FIG. 1. Extending aft the bow 12 along the hull's long axis is a lower longitudinal keel 16. As shown in FIG. 3, the keel preferably defines a smooth line with a first support point 15 defined at a deep keel line and a second support point 19. The support points 15, 19 define the lower most points of the keel.

A wave portion 17 is located between the first and second support points. For additional support, the sidewalls 22 of the hull extend continuously downward on starboard and port sides 40, 60 terminating at starboard and port side stabilizers 42, 62, respectively. The stabilizers provide additional stability. The support points 15, 19 and stabilizers 42, 62 form a unique four-point support structure, which is illustrated in the phantom lines of FIG. 4. The Applicant has coined the terms "strength diamond" to describe the characteristic shape defined by connecting the points of the hull that make contact with the water surface to support the boat. This support configuration has been found to provide improved support enabling increased load limits and stress tolerances not supported by twin spaced keel designs. An increased area of deck space can be designed in boat applications heretofore not possible.

Aft the deep keel first support point 15, is a wishbone-shaped indention formed in the hull between the bow 12 and the stern 14. The overall wishbone shape may alternatively be described as a bilaterally symmetrical indention 32 that has a forward end 33 and a rearward end 35 located above the water line 100, as shown in FIG. 1. The indention 32 is directed rearwardly and outwardly from the lower longitudinal keel, which produces a second cut, therefore, for displacing water toward the stern on both the portside 60 and starboard side 40.

With reference to FIGS. 4-7, the symmetrical indention, in cross-sectional shape, defines a U cushioning surface 38. At rest, as the hull experiences wave action, the bow of the boat is lifted by the wave. Unlike traditional hull designs, however, the new wave portion 17 of the keel 16 requires that the water "climb" higher to make contact with the hull 20 and lift the boat. Additionally, if the wave breeches the height of the indention 32 and contacts the hull's U cushioning surface 38, the indention directs the water rearwardly and outwardly. It does not lift the boat.

When the points of the novel hull that contact the water's surface, i.e., points 15, 19 and stabilizers 42, 62, are compared in surface area to the contact area of known hulls, the benefits are pronounced. The stabilizers 42, 62 and first and second support points 15, 19 of the new design generally cut through the water instead of being lifted by it; and this yields a smoother more horizontal attitude of the boat during choppy waters at sea or off-coast. The new features of the hull 20 offer improved movement through the water as well.

When accelerating and attempting to plane a craft comprising the hull 20, the first V hull 26 cuts the water and divides the spray outward to the starboard 40 and port 60 sides of the boat via the impressions 27. The boat rises, and water is directed by the wishbone-shaped indention 32 as described above, which causes the boat to more quickly reach vertical acceleration. The second V hull 36 formed in the stern portion 29 then significantly reduces drag. In its front, in cross sectional shape (FIG. 6), the second V hull 36 has a pronounced V shape. The front end also directs the water and displaces it rearwardly and out through the rearward end(s) 35, which are above the water line 100 on both sides of the boat 10, as shown in FIG. 1.

Figure 7:
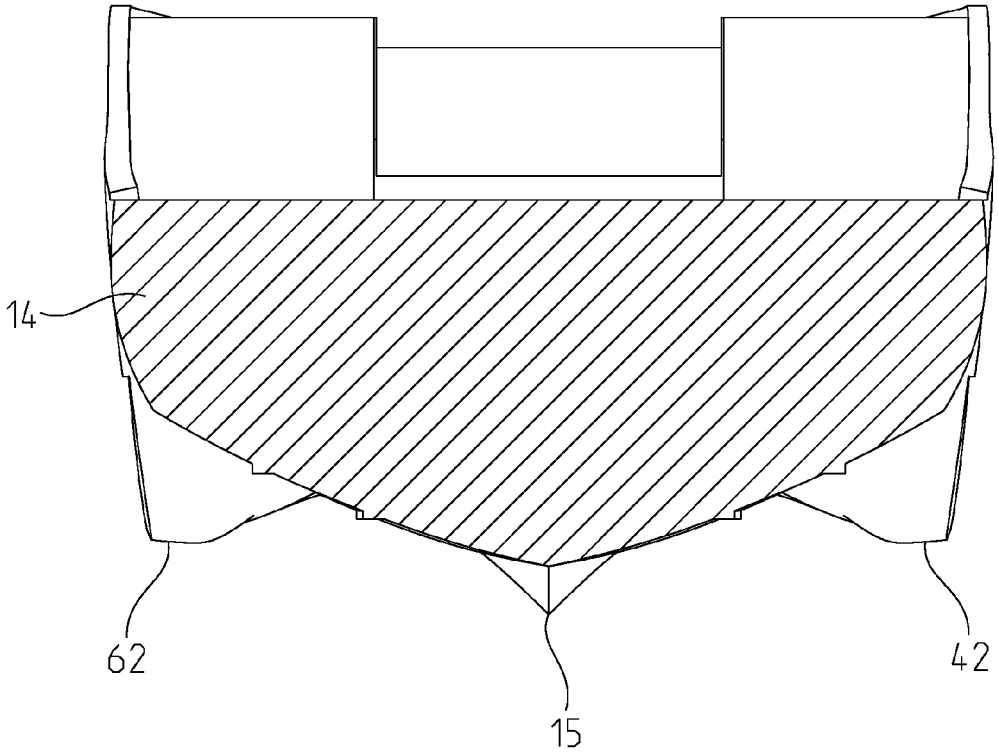
FIG. 7 is another enlarged sectional view taken along lines 7-7 of FIG. 4.

Referring to FIG. 7, aft the front end, the second hull 36 transitions into a modified V hull. The stern portion 29 of the hull thus cuts water at its front and supports the boat at the stern 14. Vertical acceleration and measured support is optimum as a result. The drag is minimized, which adds to fuel efficiency and performance.

While the invention has been illustrated and described in detail in the drawings and foregoing description, the same is to be considered illustrative and not restrictive in character. It is understood that the embodiments have been shown and described in the foregoing specification in satisfaction of the best mode and enablement requirements. It is understood that one of ordinary skill in the art could readily make a nearly infinite number of insubstantial changes and modifications to the above-described embodiments and that it would be impractical to attempt to describe all such embodiment variations in the present specification. Thus, it is understood that it is desirable to protect all the changes and modifications that come within the spirit of the invention.

The invention claimed is:

1. A boat hull having a bow, a stern and a lower longitudinal keel extending between the bow and stern, said hull comprising:

a first V hull formed at the bow; and a second V hull formed aft the bow, wherein said second V hull is defined by a bilaterally symmetrical indention having a forward end and a rearward end, the indention is directed rearwardly and outwardly from the lower longitudinal keel, the rearward end is above a water line for displacement of water toward the stern on both the portside and starboard side.

2. A boat hull according to claim 1, wherein said indention, in cross-sectional shape, defining a U cushioning surface.

3. A boat hull according to claim 2, wherein the lower longitudinal keel, from bow to stern, having a wave portion.

4. A boat hull according to claim 3, wherein said forward end(s) of the bilaterally symmetrical indention coincide to define a first support point.

5. A boat hull according to claim 1, wherein said first V hull includes a portside stabilizer and a starboard side stabilizer.

6. A boat hull according to claim 5, wherein said port- and starboard side stabilizers are continuous with sidewalls of the first V hull.

7. A boat hull having a bow, a stern and a lower longitudinal keel extending between the bow and stern, said hull comprising:

a wave portion defined along the length of said longitudinal keel; and a first V hull formed at a bow portion, the first V hull includes bilaterally symmetrical impressions for cutting and directing water outward and aft from the keel, said bow portion includes a portside stabilizer and a starboard side stabilizer; and a second V hull formed aft said bow portion, wherein said first and second V hulls defining, respectively, a first support point and a second support point, said first and second support points are situated in-line along the longitudinal keel, and the port- and starboard side stabilizers are aligned transverse of the keel for providing boat support.

8. A boat hull according to claim 7, wherein said port- and starboard side stabilizers are continuous with sidewalls of the first V hull.

9. A boat hull according to claim 7, wherein said second V hull is defined by a bilaterally symmetrical indention having a forward end and a rearward end, the indention is directed rearwardly and outwardly from the lower longitudinal keel, the rearward end is above a water line for displacement of water rearwardly and outwardly toward the stern on both the portside and starboard side.

10. A boat hull according to claim 7, wherein a wishbone-shaped indention is formed between the first and second V hulls.

11. A boat hull according to claim 10, wherein said indention, in cross-sectional shape, defining a U cushioning surface.

* * * * *